US008267715B2

(12) United States Patent
Roosdorp et al.

(10) Patent No.: US 8,267,715 B2
(45) Date of Patent: Sep. 18, 2012

(54) CLOSED IDC TERMINAL

(75) Inventors: Joannes Willem Maria Roosdorp, Paulista (BR); Henry Charles Canteri, Paulista (BR)

(73) Assignee: Tyco Electronics Brasil Ltda, Sao Paulo (BR)

( * ) Notice: Subject to any disclaimer, the term of this patent is extended or adjusted under 35 U.S.C. 154(b) by 198 days.

(21) Appl. No.: 12/308,349

(22) PCT Filed: Jun. 14, 2007

(86) PCT No.: PCT/BR2007/000154

§ 371 (c)(1),
(2), (4) Date: Sep. 23, 2010

(87) PCT Pub. No.: WO2007/143805

PCT Pub. Date: Dec. 21, 2007

(65) Prior Publication Data

US 2011/0217866 A1 Sep. 8, 2011

(30) Foreign Application Priority Data

Jun. 14, 2006 (BR) ..... 0602294

(51) Int. Cl.
*H01R 4/24* (2006.01)

(52) U.S. Cl. ..... 439/404

(58) Field of Classification Search ..... 439/404, 439/417, 397–398

See application file for complete search history.

(56) References Cited

U.S. PATENT DOCUMENTS

| | | | | |
|---|---|---|---|---|
| 5,727,967 | A * | 3/1998 | Chen | 439/418 |
| 5,782,652 | A * | 7/1998 | Feher et al. | 439/417 |
| 5,820,402 | A * | 10/1998 | Chiacchio et al. | 439/398 |
| 6,206,735 | B1 * | 3/2001 | Zanolli | 439/736 |
| 6,488,539 | B1 * | 12/2002 | Turek et al. | 439/620.21 |
| 6,875,044 | B1 * | 4/2005 | Lee | 439/404 |
| 7,059,889 | B1 * | 6/2006 | Pavlovic et al. | 439/397 |
| 7,413,465 | B2 * | 8/2008 | Taylor | 439/409 |
| 2003/0077934 | A1 * | 4/2003 | Mansur | 439/404 |
| 2003/0181092 | A1 * | 9/2003 | Negishi et al. | 439/404 |
| 2006/0030199 | A1 * | 2/2006 | Chung Long Shan | 439/404 |
| 2006/0160403 | A1 * | 7/2006 | Duesterhoeft et al. | 439/404 |
| 2006/0172585 | A1 * | 8/2006 | Tashiro et al. | 439/404 |
| 2007/0128919 | A1 * | 6/2007 | Demuth et al. | 439/404 |
| 2009/0269969 | A1 * | 10/2009 | Siev et al. | 439/404 |

* cited by examiner

*Primary Examiner* — Jean F Duverne

(57) ABSTRACT

This present invention refers to a combined terminal and casing for establishing electrical contact between a multi-wire cable and a magnetic wire that uses the insulation displacement connector (IDC) concept, wherein the terminal (11, 25) has holes (12, 26) and closed channels (13, 27) to receive the multi-wire cable (23, 36) and openings (14, 28) to receive the magnetic wire (24, 37) linked to narrow slots (15, 29). The casing (18, 31) has through-holes (20, 21, 32, 34) for inserting the multi-wire cable (23, 36) and the magnetic wire (24, 37), as well as an opening (19, 35) to receive the terminal. Inserting the terminal into the casing causes the pressure exerted on the multi-wire cable and the magnetic wire to force the entry thereof into the narrow channels, causing the isolation layer to be withdrawn, providing electrical contact between the multi-wire cable and the terminal, between the magnetic wire and the terminal and, consequently, between the multi-wire cable and the magnetic wire.

19 Claims, 14 Drawing Sheets

CLOSED IDC TERMINAL

CROSS-REFERENCE TO RELATED APPLICATIONS

This application claims the benefit of the filing date under 35 U.S.C. §120 of International Patent Application No. PCT/BR2007/000154 filed Jun. 14, 2007, which claims the priority of Brazil Patent Application No. PI0602294-4 filed Jun. 14, 2006.

FIELD OF THE INVENTION

The present invention refers to interfaces providing electrical contact between magnetic wires and multi-wire isolated cables for use in electro-electronic equipment, such as universal engines and lamp reactors.

BACKGROUND OF THE ART

In order to function, electronic equipment generally needs electrical contact between wires and cables in order to propagate electrical power.

For example, engine windings, bobbins, transformers and power generators use metallic terminals to establish an electrical contact between two wires, enabling the propagation of electric power among the various wires and cables of which the device is comprised.

Currently, this contact can be obtained by way of metallic terminals that use crimp application. In this case, contact is achieved by way of a tube comprising projections and teeth. The projections perforate the isolation layer of the magnetic wire, causing the exposed conductor to be compressed towards the teeth, creating an electrical connection between the metallic tube and the magnetic wire.

However, in order to establish contact between magnetic wires and multi-wire cables, the latter must be pre-stripped. Additionally, said device has certain limitations, since the multi-wire cables must be placed in a specific position, which may hamper the correct positioning thereof.

Another disadvantage of terminals that use crimping technology arises from the fact that the pre-stripped wire and the terminal are deformed when high pressure is exerted thereon. This requires careful handling and constant monitoring of the terminal.

Isolation layer of a wire is understood to be both the plastic layer that incases copper wires and multi-wire cables, and the layer of varnish applied to magnetic wires, having the same purpose of isolating the internal conductor part from the outside world.

Another device currently used to establish contact between magnetic wires and multi-wire cables employs the isolation displacement connector (IDC) concept. According to this concept, the isolated wire is pressed into a slot designed to displace isolation and remove oxides through deformation in a given place of the plastic.

In this case, there is no need for prior stripping of the multi-wire cable, and two wires having the same diameter can be simultaneously placed in the same terminal. The metallic interface is free of contaminants, which renders the electrical contact stable. Moreover, there is no need to use large machines to establish contact.

The terminal of the prior art presents two openings to receive the multi-wire cable and the magnetic wire. However, the opening that receives the multi-wire cable has an open end. As the multi-wire cable and the isolating material to be removed are thick, a high mechanical tension is required to insert the cable into the opening. This strains the terminal, and may lead to a permanent deformation of the opening, consequently generating deficiencies in the electrical conductivity.

To reduce this undesirable effect, the terminal is made of a double-thickness premilled raw material, the larger thickness being designed to house the channel where the multi-wire cable will be connected. The use of this double-thickness premilled raw material results in increased production difficulty and higher costs for the end product.

Furthermore, the multi-wire cable is inserted in an opposite direction to the magnetic wire. Accordingly, two termination cycles are required to achieve electrical contact of the wires with the terminal.

Another embodiment of the prior art refers to a terminal having two sets of parallel channels, for use in applications that undergo vibration. In this case, one of the channels is slightly wider than the other, in order to absorb the vibration in the cable, preventing loss of electrical contact between the cable and the terminal, thus guaranteeing greater connection reliability.

Nevertheless, just like the simple contact terminal, the parallel channels that receive the multi-wire cable are open-ended. Thus, the terminal has the same disadvantages as those mentioned above, such as the increase of channel width owing to the high mechanical tension needed to remove the isolation layer of the cable at the open end, resulting in deficiencies in electrical conductivity.

SUMMARY OF THE INVENTION

The purpose of the present invention is to solve the problems of the prior art mentioned above, providing a combination comprised of two parts, the terminal itself and a casing to house the connection, using the channel concept (IDC).

The purpose of the present invention is to provide an efficient connection between cables and magnetic wires, where there is no loosening at the connection point that would cause a failure of the normal contact power.

Additionally, another purpose of the present invention is to provide a terminal with a single thickness in order to reduce production costs.

A further purpose of the combination for establishing electrical contact of the present invention is to provide a metallic terminal that allows contact between the magnetic wire and the isolated cable, without the need for crimping. The terminal has two channels for inserting the wires. The channel relating to the multi-wire cable is closed, which prevents loosening caused by stress, and failure in the normal connection power. Accordingly, the terminal does not need to be made of thick material, but can be entirely made of a thinner raw material, such as that used in the part destined for the magnetic wire. This feature means the product can be manufactured with a constant thickness, thus reducing the end cost.

Yet another purpose is to provide a combination for establishing electrical contact wherein the casing is designed to house the terminal and receive and position the multi-wire cable and the magnetic wire, besides isolating the contact in the terminal from the outside world. By inserting the terminal into the casing, certain points of the isolating material are cut, providing for electrical contact of the wire with the metallic terminal. This arrangement makes the application of both the cable and the wire occur simultaneously, in one cycle alone, since both are inserted into the respective channels in the same direction.

The purposes of the present invention are achieved by providing a terminal and casing combination for electrical contact, comprising a contact interface terminal between a magnetic wire and a multi-wire isolated cable and a casing to receive the terminal, the magnetic wire and the multi-wire cable, wherein the terminal is formed by a single material having constant thickness. The terminal has a hole for inserting the multi-wire cable, a closed channel linked to said hole and having a smaller diameter than said hole, an opening to receive the magnetic wire and a slot linked to said opening, having a smaller diameter than the respective opening. The casing has an opening in its upper part to receive the terminal and through-holes to receive the multi-wire cable and the magnetic wire.

Additionally, a terminal and casing combination for electrical contact is provided, comprising a contact interface terminal between a magnetic wire and a multi-wire isolated cable and a casing to receive the terminal, the magnetic wire and the multi-wire cable. The terminal is formed by a single material having constant thickness, and has at least two parallel holes for inserting the multi-wire cable, at least two parallel closed channels linked to said holes and having a smaller diameter than said holes, at least two parallel openings to receive the magnetic wire, and two parallel slots linked to said openings, having a smaller diameter than the respective openings. Additionally, one of the closed channels is slightly larger than the other parallel channel. Alternatively, one of the parallel slots may also optionally be slightly wider than the other slot.

The channels relating to the multi-wire cable are closed, preventing wear and tear caused by inserting the thick cables and constant pressure exerted thereon. Moreover, a thinner raw material can be used in the entire terminal.

In the same way, the casing has an opening to receive the terminal and respective openings for inserting and positioning the multi-wire cable and the magnetic wire, serving to isolate the contact from the outside world. The two cables are inserted in the same direction and, therefore, in a single cycle. The cut at certain points of the isolating material causes electrical contact of the wire with the metallic terminal.

DETAILED DESCRIPTION OF THE INVENTION

Figure 1:
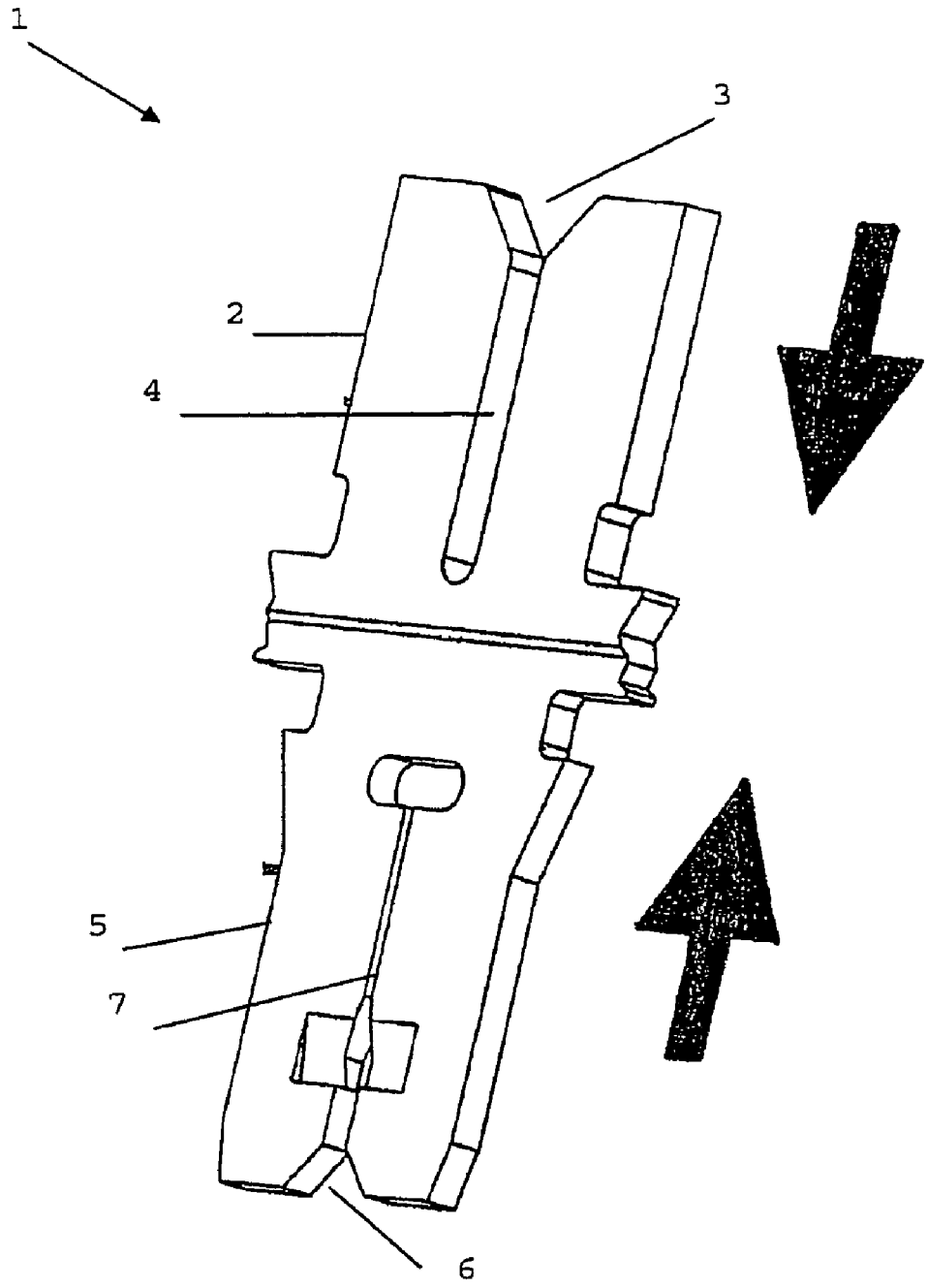
FIG.1 (PRIOR ART)
FIG. 1 is a perspective view of the terminal of the prior art in a first embodiment.

FIG. 1 illustrates a terminal of the prior art, which employs the channel concept (IDC). As can be seen, the terminal 1 comprises two parts 2 and 5, having different thicknesses. The first part 2 comprises an opening 3 to receive the multi-wire cable and a channel 4, whereas the second part 5 comprises an opening 6 to receive the magnetic wire and a slot 7, having a smaller diameter than the channel 4. As the cables are inserted into their respective openings, the pressure exerted forces the cable into a channel having a smaller diameter than the wire itself, dislodging the film that envelops the wires (plastic or varnish), thus removing the isolation at certain points and providing direct contact of the wire with the terminal.

Since the terminal is made of metal, and, therefore, conducts power, electrical contact between the magnetic wire and the multi-wire cable is established.

The arrows in FIG. 1 indicate that the multi-wire cable and the magnetic wire are inserted into their respective openings in opposite directions, meaning two termination cycles are required to establish electrical contact of the wires with the terminal.

Figure 2:
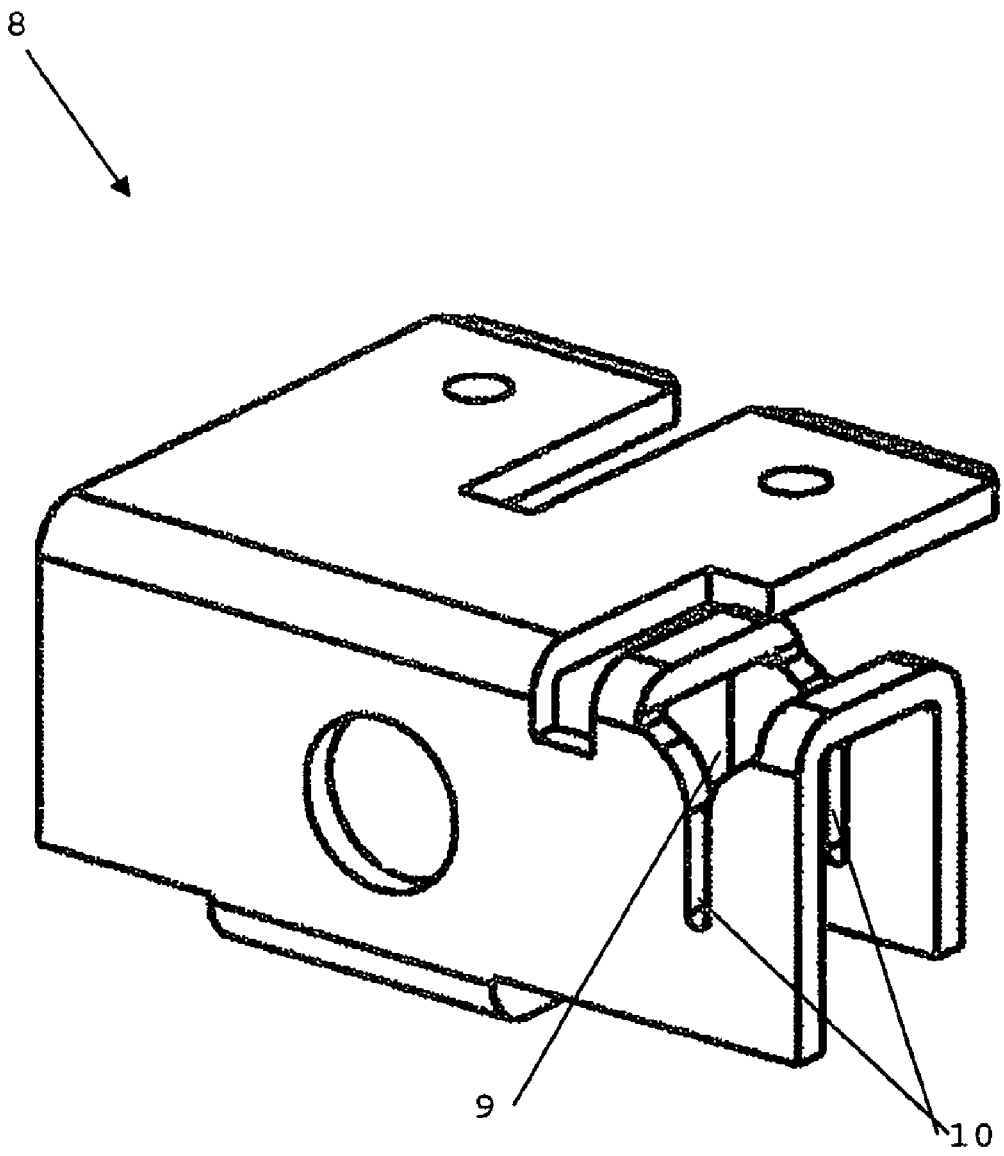
FIG.2 (PRIOR ART)
FIG. 2 is a perspective view of the terminal of the prior art in a second embodiment.

FIG. 2 is a second embodiment of the metallic terminal of the prior art. In this terminal 8, two openings 9 and two channels 10 to receive the multi-wire cable are arranged parallel, wherein one of the channels is slightly wider than the other. The purpose of this difference in width is to absorb vibrations as may occur in the equipment wherein it is installed, preventing vibration from interfering at the point of electrical contact of the terminal.

FIGS. 3 to 11 present the terminal and casing combination of the present invention in a first embodiment.

Figure 3:
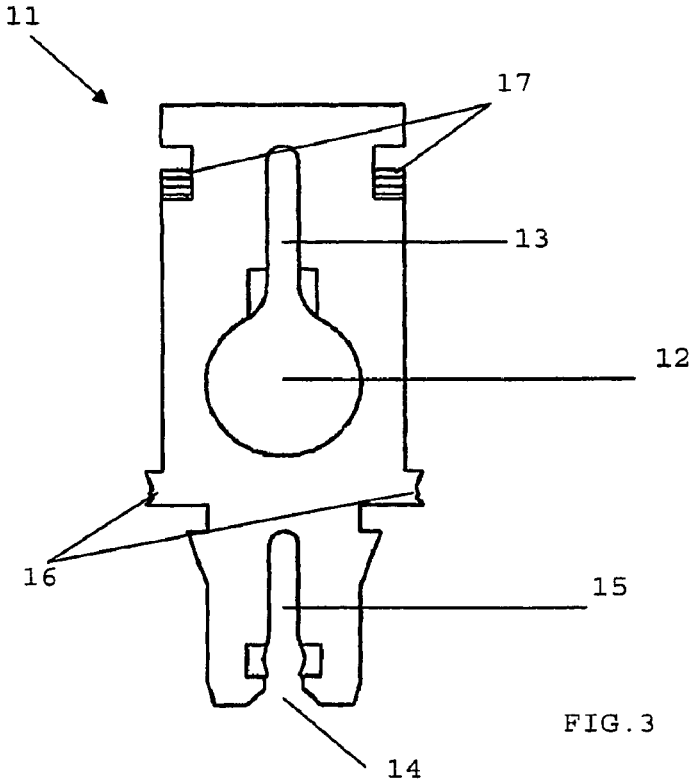
FIG. 3 is a front view of the terminal of the present invention in a first embodiment.
Figure 4:
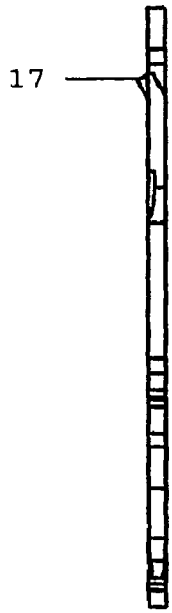
FIG. 4 is a side view of the terminal of the present invention in a first embodiment.
Figure 5:
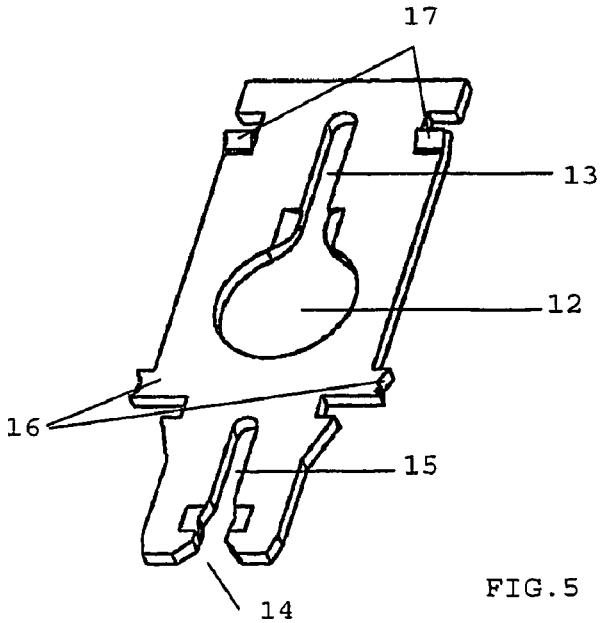
FIG. 5 is a perspective view of the terminal of the present invention in a first embodiment.

As can be seen in FIGS. 3, 4 and 5 of the drawings, the terminal 11 of the present invention comprises a hole 12 for inserting the multi-wire cable and a closed channel 13 linked to said hole 12.

Additionally, the terminal has an opening 14 linked to a slot 15 for inserting the magnetic wire.

In order to avoid displacement of the terminal inside the casing, which could compromise the electrical contact, said terminal has projections 16 to be fitted into the casing. Said projections serve as an anchor for the terminal in the casing, acting by interference. Inserting the terminal in the casing will cause the projections to drive into the plastic part of the casing. Additionally, the terminal optionally has flaps 17 to be fitted into the casing, avoiding movement that might compromise the electrical contact.

Figure 6:
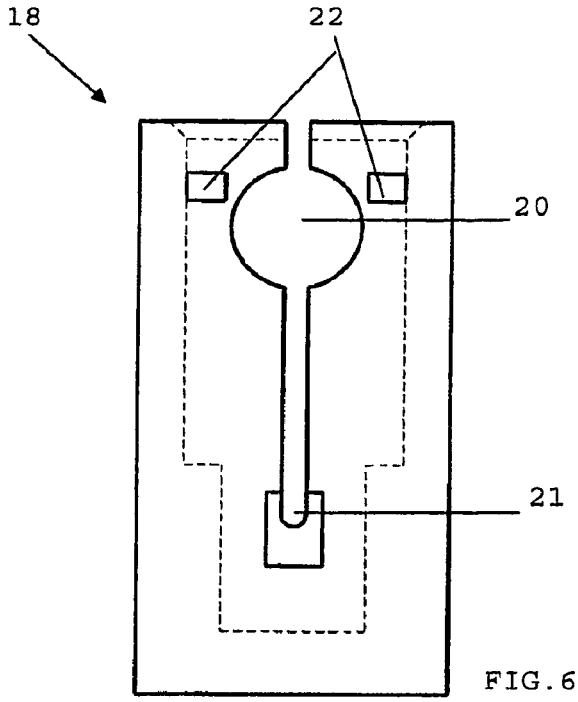
FIG. 6 is a front view of the casing of the present invention in a first embodiment.
Figure 7:
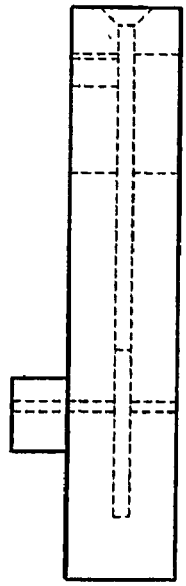
FIG. 7 is a side view of the casing of the present invention in a first embodiment.
Figure 8:
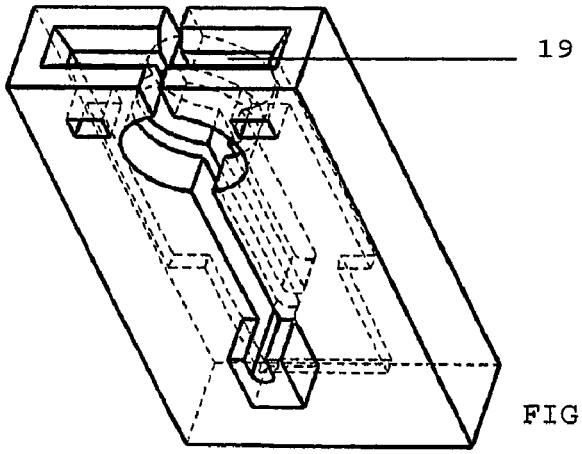
FIG. 8 is a perspective view of the casing of the present invention in a first embodiment.

FIGS. 6, 7 and 8 present an arrangement of the casing 18 of the present invention. The casing has a rectangular arrangement, comprising an opening 19 in its upper part, to receive the terminal, first and second through-holes 20 and 21 and optional windows 22.

The first through-hole 20 is designed to receive the multi-wire cable and therefore has a smaller diameter than the second through-hole 21, designed to receive the magnetic wire.

The purpose of the windows 22 is to receive said terminal flaps 17, in order to fit the terminal into the casing 18, preventing potential displacement.

Figure 9:
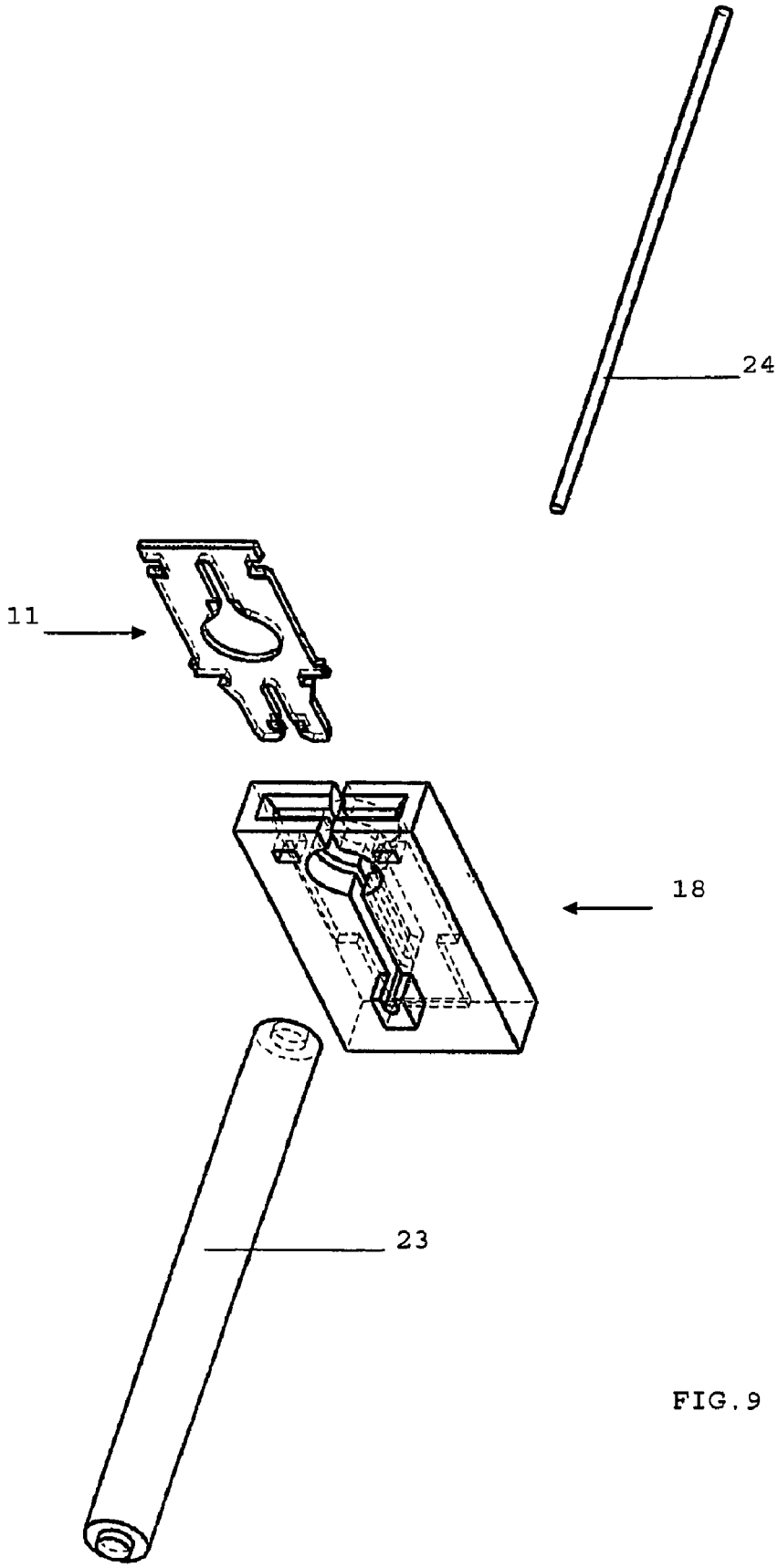
FIG. 9 is an exploded view of the combination comprising the terminal and the casing of the present invention in a first embodiment, showing the correct insert position of the multi-wire cable and the magnetic wire in the combination.
Figure 10:
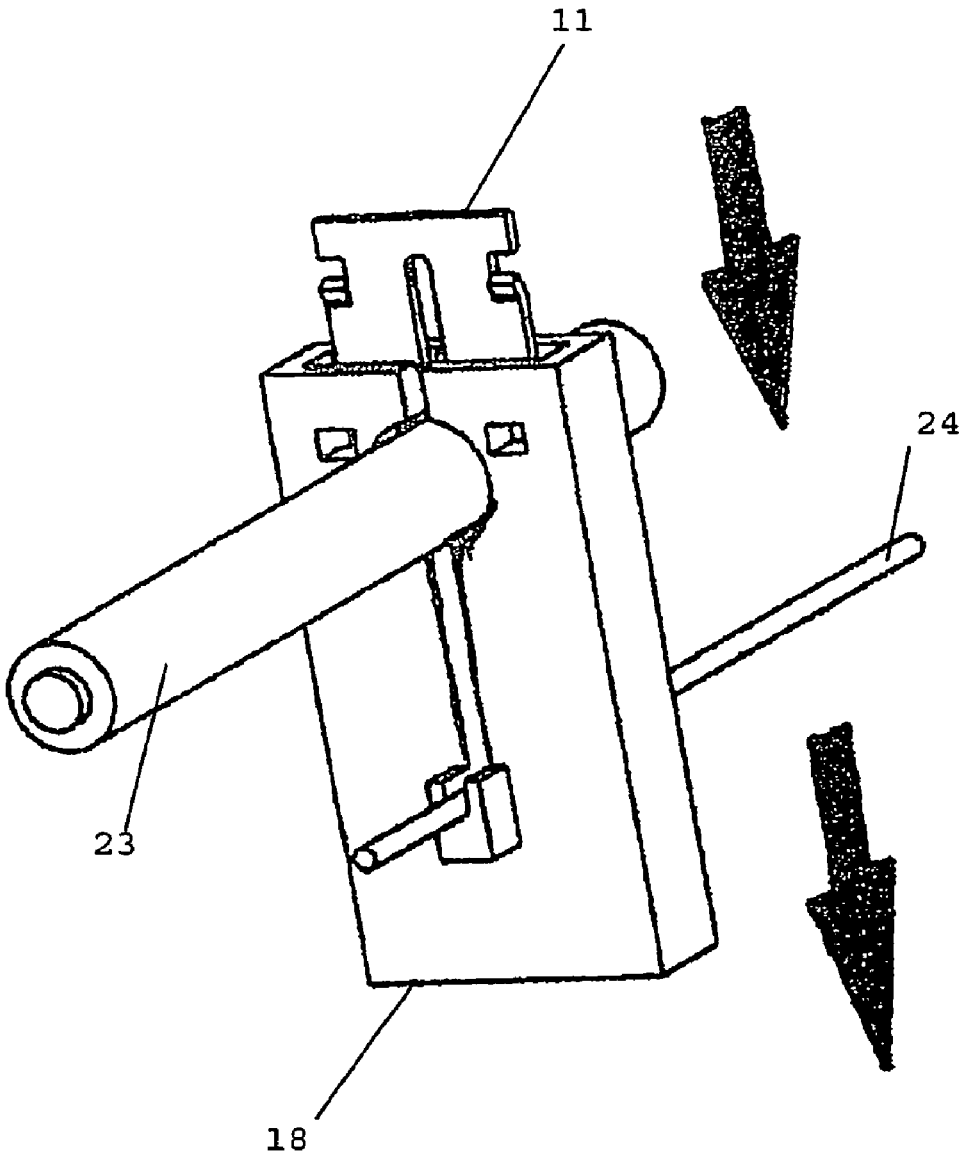
FIG. 10 is a perspective view illustrating the partial insert of the multi-wire cable and the magnetic wire in the terminal and in the casing in a first embodiment.
Figure 11:
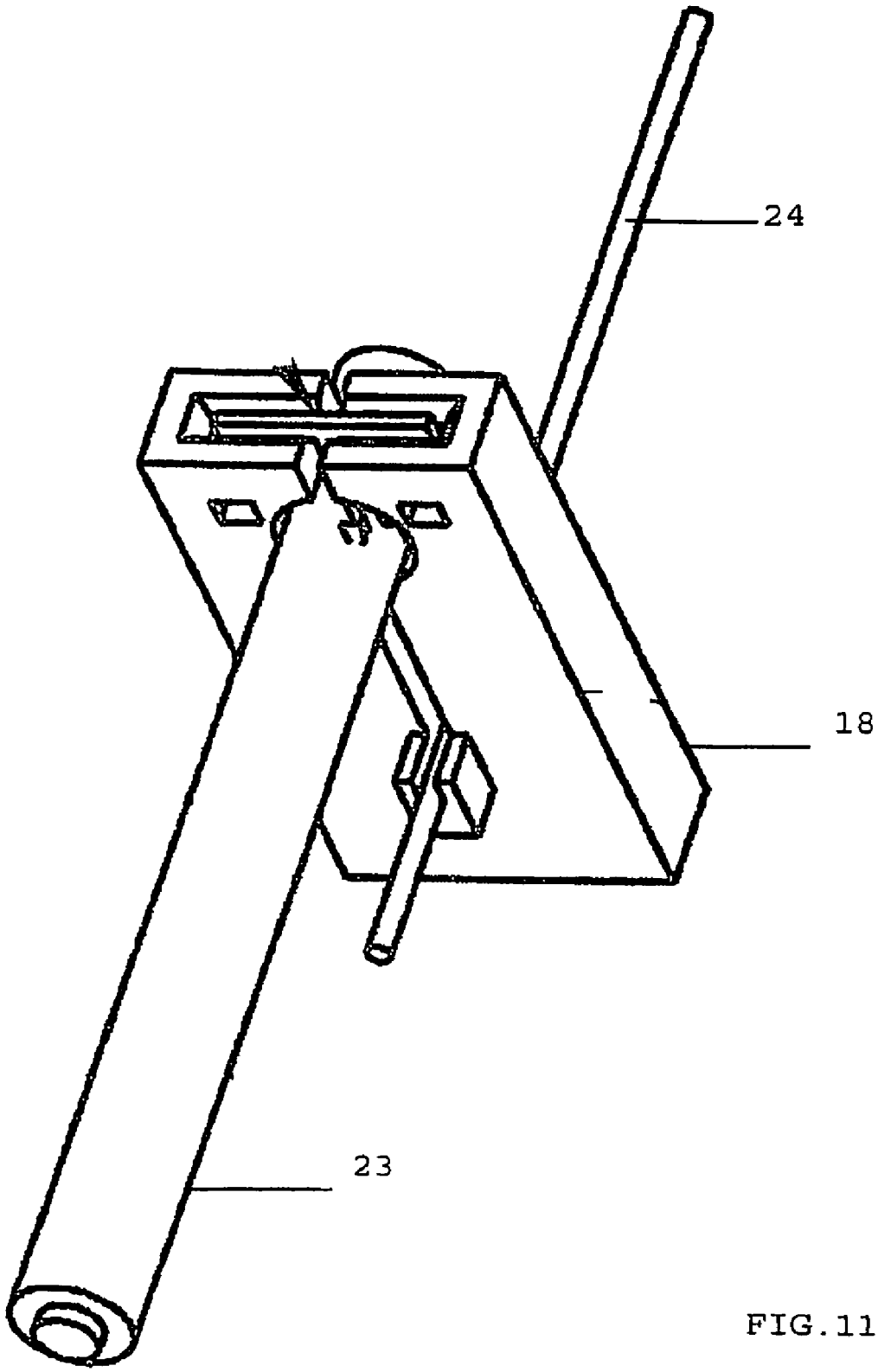
FIG. 11 is a perspective view of the final position of the combination in a first embodiment, with the multi-wire cable and the magnetic wire inserted therein.
Figure 12:
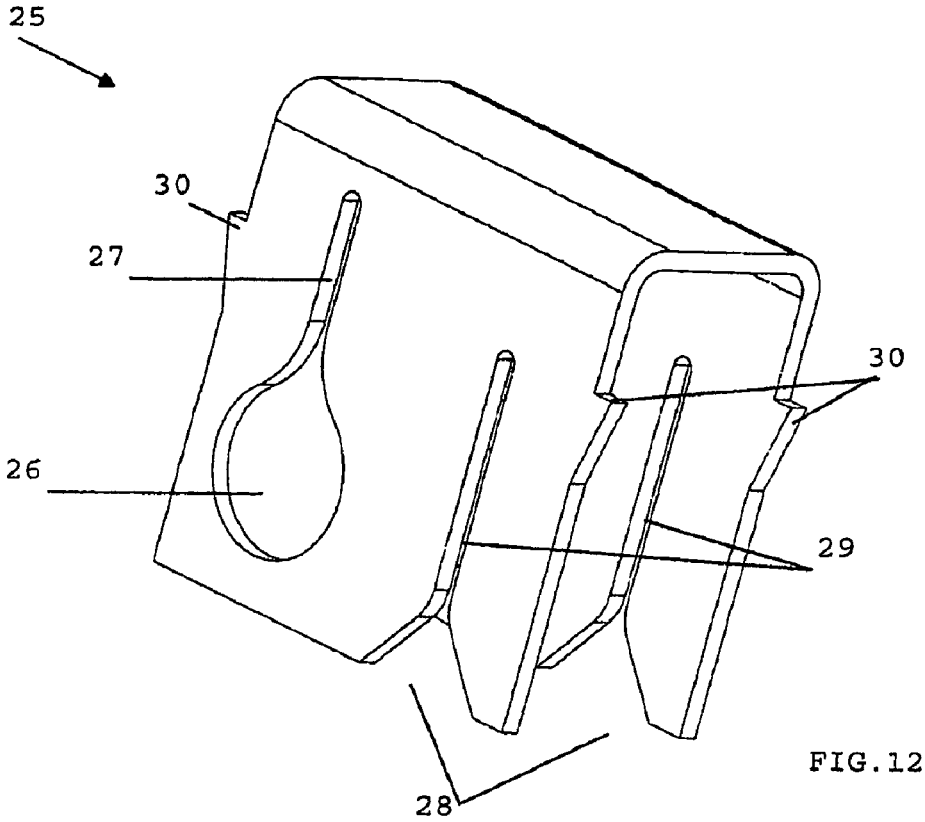
FIG. 12 is a perspective view of the terminal of the present invention in a second embodiment.
Figure 13:
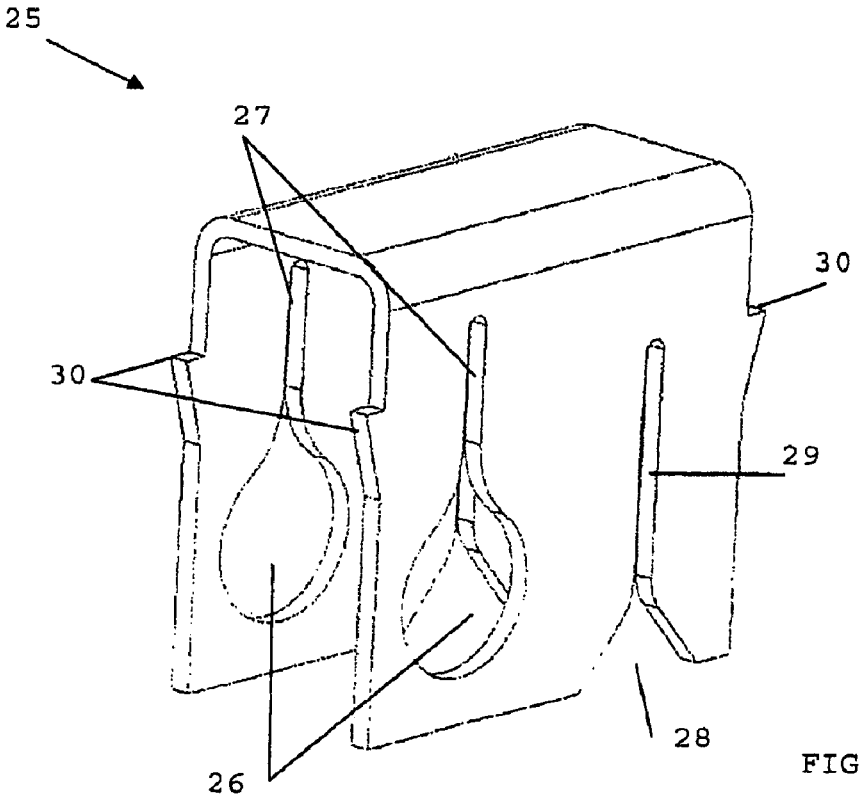
FIG. 13 is another perspective view of the terminal of the present invention in a second embodiment.
Figure 14:
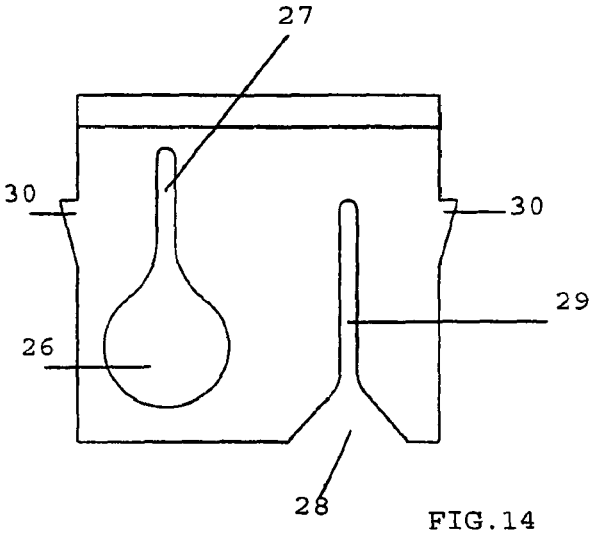
FIG. 14 is a front view of the terminal of the present invention in a second embodiment.
Figure 15:
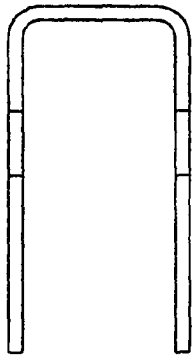
FIG. 15 is a side view of the terminal of the present invention in a second embodiment.
Figure 16:
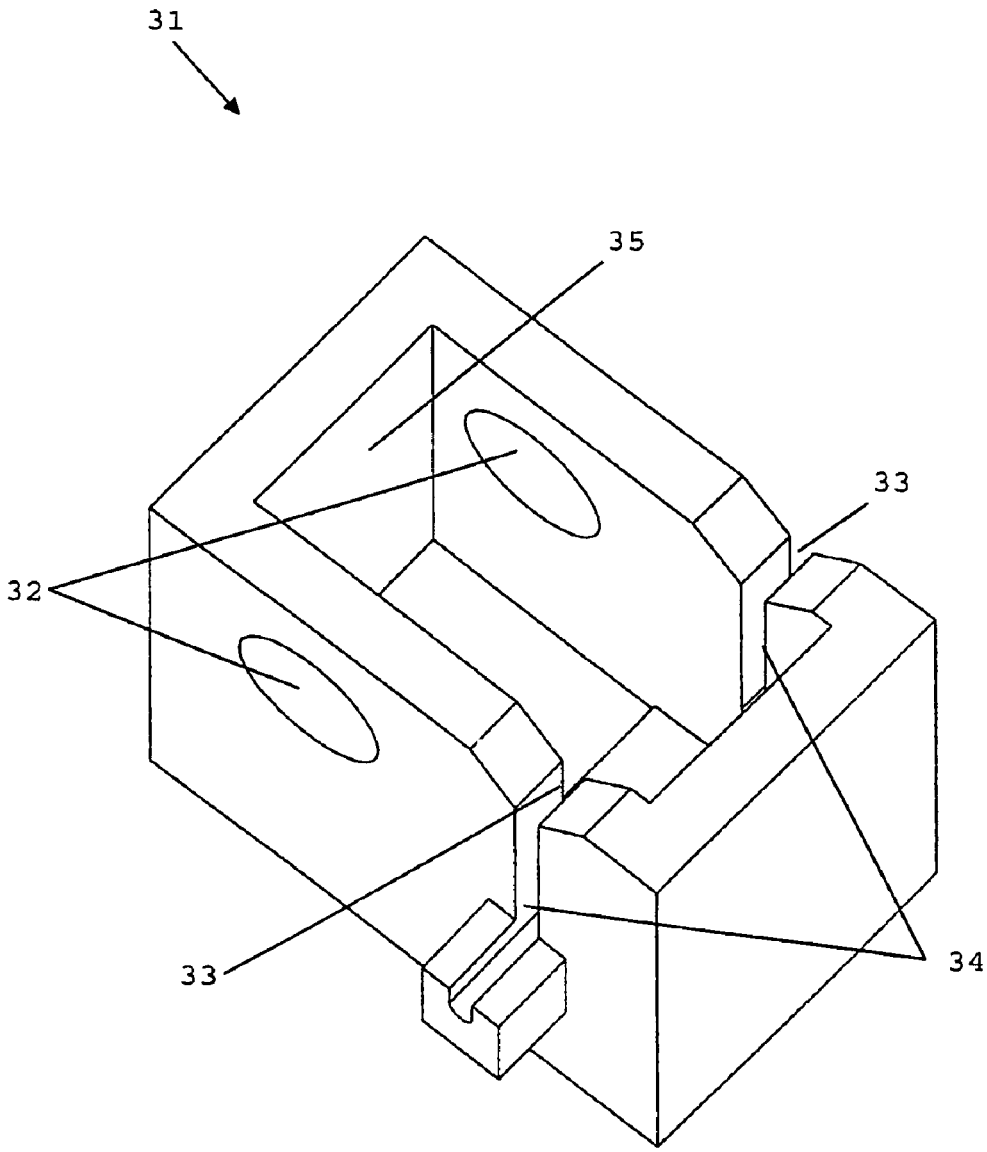
FIG. 16 is a perspective view of the casing of the present invention in a second embodiment.
Figure 17:
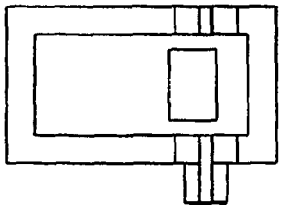
FIG. 17 is an upper view of the casing of the present invention in a second embodiment.
Figure 18:
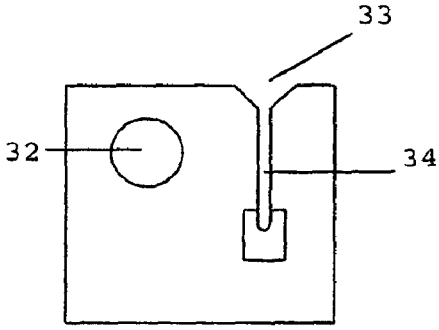
FIG. 18 is a front view of the casing of the present invention in a second embodiment.
Figure 19:
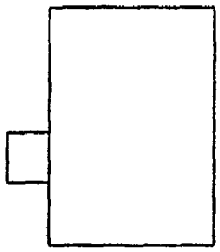
FIG. 19 is a side view of the casing of the present invention in a second embodiment.

FIGS. 9, 10 and 11 present successive views of how the multi-wire cable and the magnetic wire are inserted into the combination.

FIG. 9 is an exploded view of the terminal 11 and casing 18 combination, indicating the correct position for inserting the multi-wire cable 23 and the magnetic wire 24.

FIG. 10 shows the correct insert position the components, with the terminal 11 being inserted into the opening 19 in the upper part of the casing 18, the multi-wire cable 23 being inserted into the smaller-diameter hole 20 of the casing 18 and the magnetic wire 24 being inserted into the hole having a smaller diameter 21.

The combination is operated as follows. The terminal should be inserted into the casing until its hole 12 (see FIG. 3) reaches the same position as the smaller-diameter hole 20 (see FIG. 6) of the casing. In this position, there is also an opening to receive the magnetic wire 14 of the terminal aligned with the smaller hole 21 of the casing.

At this point, the multi-wire cable 23 and the magnetic wire 24 should be inserted into the combination in their respective positions, up to the point at which it is desirable to withdraw the isolation layer. This arrangement of the components is presented in FIG. 10.

FIG. 11 presents the final arrangement of the combination. Since the terminal channel 13 is narrower than its hole 12, the multi-wire cable is forced into the channel 13 when the terminal is completely inserted into the casing. This forced passage through the narrower channel will cause minor cuts in the cable's isolation layer. Since the channel is closed, the insertion of the terminal into the casing will establish a direct and efficient contact between the multi-wire cable and the metallic terminal.

The process is similar for the magnetic wire. By inserting the terminal into the casing, the magnetic wire 24 is forced inside the slot 15, the isolation and the layer of varnish that protect the wire are withdrawn at certain points, and a direct contact between the wire and the terminal is established.

Therefore, FIG. 11 presents the final position of the terminal and casing combination, with the electrical contact already established between the multi-wire cable and the magnetic wire.

FIGS. 12 to 22 present the terminal and casing combination of the present invention in a second embodiment, to be used in applications subject to vibration.

As can be seen in FIGS. 12 to 15, the terminal 25 of the present embodiment presents two combinations for connecting the multi-wire cable and the magnetic wire. At least two parallel holes 26 are provided for insertion of the multi-wire cable linked to at least two parallel closed channels 27. Additionally, the terminal has at least two parallel openings 28 linked to at least two parallel slots 29 for inserting the magnetic wire.

Additionally, the terminal has projections 30 and optional flaps (not shown) for insert into the casing.

In order to absorb vibrations that may impact the combination, one of the parallel channels 27 that receive the multi-wire cable is slightly wider than the other parallel channel. The purpose of the wider channel is to provide support for the conductor without necessarily deforming it. Since a deformation of the conductor occurs in the narrower channel by virtue of the displacement of the isolating material, the mechanical contact becomes weak at this point, meaning the vibration may compromise the contact. Therefore, the main reason why one of the parallel channels is wider is to prevent movement of the conductor in the narrower channel when the combination is submitted to vibrations, guaranteeing a more reliable connection.

Alternatively, one of the parallel slots 29 designed to receive the magnetic wire may also optionally be wider than the other, in order to absorb the vibration better and to provide a mechanically more efficient connection.

FIGS. 16 to 19 present an arrangement of the casing 31 of a second embodiment of the present invention.

As can be seen in the figures, the casing 31 has parallel through-holes 32 to receive the multi-wire cable, parallel openings 33 to receive the magnetic wire, linked to parallel slots 34. Furthermore, there is an opening 35 in an upper part of the casing to receive the terminal, and optional windows (not shown) to fasten the terminal.

Figure 20:
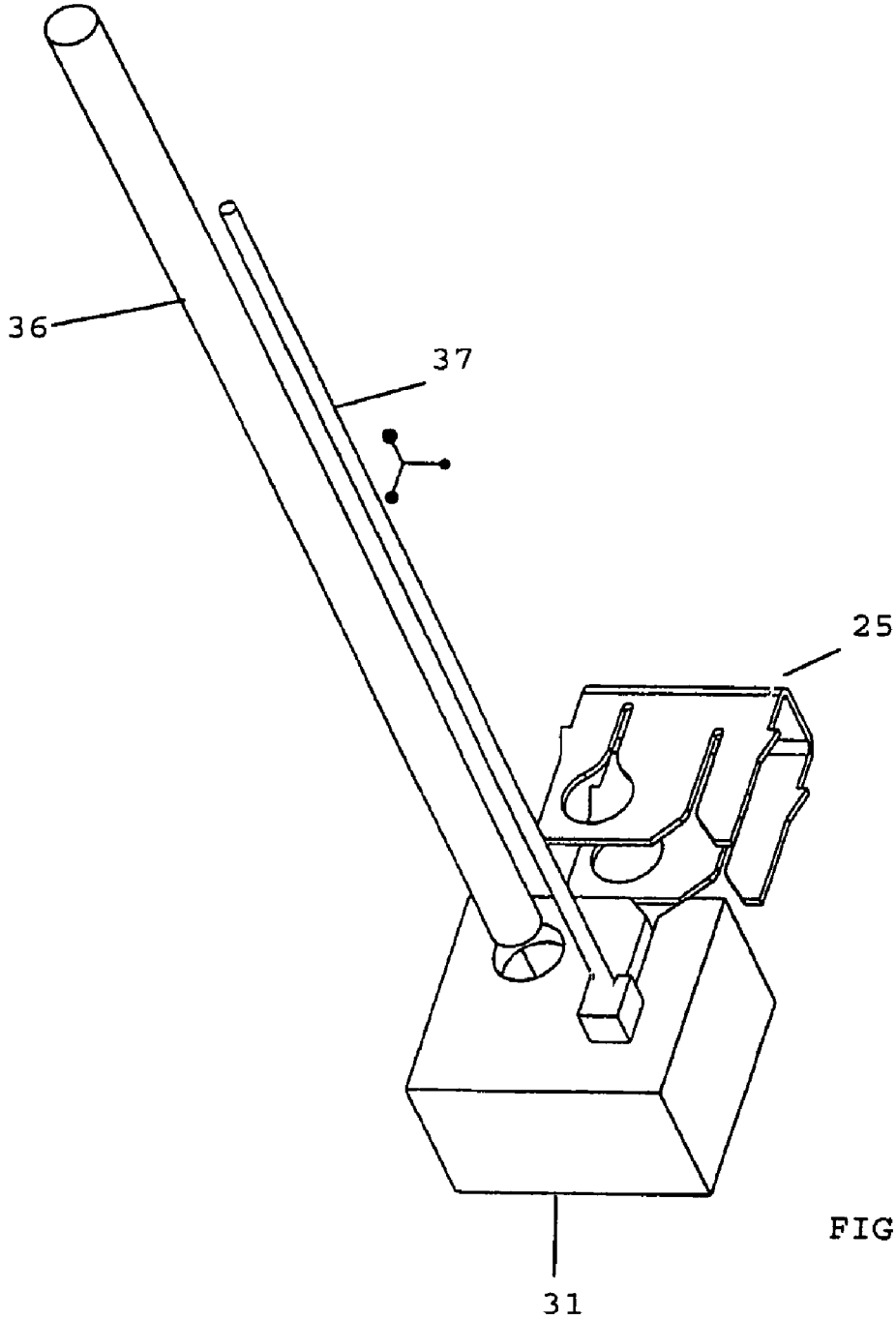
FIG. 20 is an exploded view of the combination comprising the terminal and the casing of the present invention in a second embodiment, showing the correct insert position of the multi-wire cable and the magnetic wire in the combination.
Figure 21:
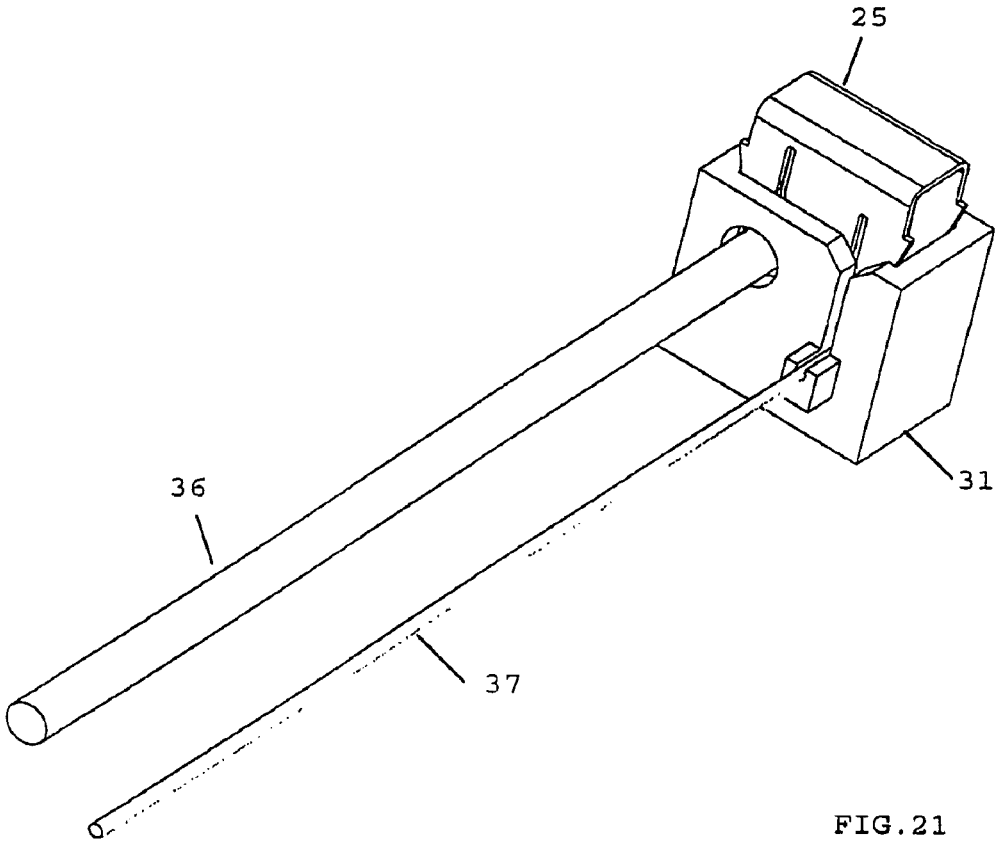
FIG. 21 is a perspective view illustrating the partial insert of the multi-wire cable and the magnetic wire in the terminal and in the casing in a second embodiment.
Figure 22:
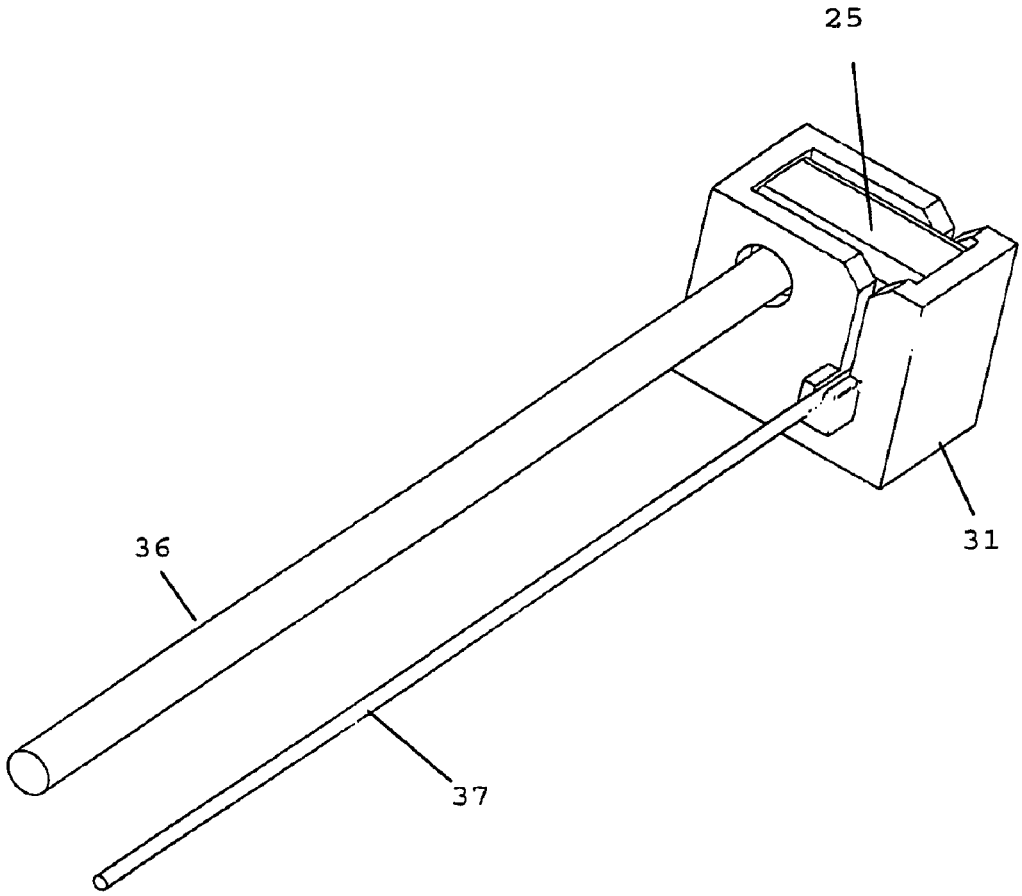
FIG. 22 is a perspective view of the final position of the combination in a second embodiment, with the multi-wire cable and the magnetic wire inserted therein.

FIGS. 20 to 22 present successive views of the insert of the multi-wire cable 36 and the magnetic wire 37 into the terminal and casing combination.

Similarly to the insert carried out in the first embodiment of the present invention, the multi-wire cable 36 and the magnetic wire 37 must be correctly positioned in the casing, jointly with the terminal 25, as illustrated in FIG. 20.

The multi-wire cable 36 and the magnetic wire 37 should then be inserted into the terminal 25 up to the point where contact is desired. With the subsequent full insertion of the terminal 25 into the casing 31, the isolating material will be displaced at a point of the multi-wire cable 36 and the magnetic wire 37 and consequently contact with the terminal will be achieved. When the terminal is fully inserted into the casing, the terminal 25 projections 30 will be driven into the plastic of the casing, fastening the terminal to the casing.

It is important to note that the multi-wire cable and the magnetic wire are inserted into the terminal and casing combination in the same direction, as indicated by the arrows in FIG. 10, enabling the respective contacts between the multi-wire cable and the terminal, and between the magnetic wire and the terminal, to occur simultaneously. Thus, just a single cycle is required to establish electrical contact between the multi-wire cable and the magnetic wire, saving assembly time for the combination.

Moreover, this application can be carried out by using simple manual tools for equipment maintenance and when production is not large-scale.

Additionally, the fact that the channel designed to receive the multi-wire cable is closed, results in less loosening in the region of contact of the terminal, providing more efficient electrical conductivity. Accordingly, there is no need to make this channel with a thick material. Therefore, the terminal can be made with a constant thickness, resulting in lower manufacturing costs.

Although the above description refers to preferred embodiments, persons skilled in the art should understand that the present invention is not limited to the details set forth in the teachings above.

It is important to note that variations, changes and amendments of the invention described herein are possible for persons skilled in the art, without straying from the spirit and scope of the present invention or equivalents thereof, encompassed within the claims appended hereto and their equivalents.

The invention claimed is:

1. A closed IDC terminal for establishing electrical contact between an isolated multi-wire cable and an isolated magnetic wire, the closed IDC terminal comprising:

a contact interface terminal formed by a single material having a constant thickness; and a casing to receive the contact interface terminal, the multi-wire cable, and the magnetic wire;

wherein the terminal has a hole for inserting the multi-wire cable, a closed channel linked to the hole, the closed channel having a smaller diameter than the hole, the closed channel extending in a first direction from the hole, an opening to receive the magnetic wire, and a slot linked to the opening, the slot having a smaller diameter than the opening, the slot extending in the first direction from the opening;

wherein the insertion of the multi-wire cable into the closed channel and the magnetic wire into the slot occurs at the same time and the contact between the multi-cable wire and the magnetic wire occur simultaneously.

2. The closed IDC terminal of claim 1 wherein the casing has an opening in an upper part to receive the contact interface terminal and two through-holes to receive the multi-wire cable and the magnetic wire.

3. The closed IDC terminal of claim 1 wherein the contact interface terminal further comprises one or more flaps for insertion into the casing.

4. The closed IDC terminal of claim 3 wherein the casing further comprises one or more windows to receive the flaps.

5. The closed IDC terminal of claim 1 wherein the contact interface terminal is made of a metallic material.

6. The closed IDC terminal of claim 5 wherein the metallic material is a copper alloy.

7. The closed IDC terminal of claim 1 wherein the casing is made of a thermoplastic material.

8. The closed IDC terminal of claim 1 wherein the contact interface terminal comprises one or more projections for fitting by interference in the casing.

9. A closed IDC terminal for establishing electrical contact between an isolated multi-wire cable and an isolated magnetic wire, the closed IDC terminal comprising:

a contact interface terminal formed by a single material having a constant thickness; and a casing to receive the contact interface terminal, the multi-wire cable, and the magnetic wire;

wherein the terminal has at least two parallel holes for inserting the multi-wire cable, at least two parallel closed channels linked to the holes, the closed channels having a smaller diameter than the holes, the closed channels extending in a first direction from the holes, at least two parallel openings to receive the magnetic wire, and at least two parallel slots linked to the openings, the slots having a smaller diameter than the openings and where one of the parallel closed channels is slightly wider than the other parallel closed channel, the slots extending in the first direction from the openings;

wherein the insertion of the multi-wire cable into the parallel closed channels and the magnetic wire into the parallel slots is in the same direction and the contact between the multi-wire cable and the magnetic wire occur simultaneously.

10. The closed IDC terminal of claim 9 wherein the casing has an opening in an upper part to receive the contact interface terminal, at least two parallel through-holes to receive the multi-wire cable, and at least two parallel slots to receive the magnetic wire.

11. The closed IDC terminal of claim 9 wherein the insertion of the multi-wire cable into the parallel closed channels and the magnetic wire into the parallel slots occurs simultaneously.

12. The closed IDC terminal of claim 9 wherein the contact interface terminal further comprises one or more flaps for insertion into the casing.

13. The closed IDC terminal of claim 12 wherein the casing further comprises one or more windows to receive the flaps.

14. The closed IDC terminal of claim 9 wherein the contact interface terminal is made of a metallic material.

15. The closed IDC terminal of claim 14 wherein the metallic material is a copper alloy.

16. The closed IDC terminal of claim 9 wherein the casing is made of a thermoplastic material.

17. The closed IDC terminal of claim 9 wherein the contact interface terminal further comprises one or more projections for fitting by interference in the casing.

18. The closed IDC terminal of claim 9, wherein one of the parallel slots for inserting the magnetic wire into the contact interface terminal is slightly wider than the other parallel slot.

19. A closed IDC terminal for establishing electrical contact between an isolated multi-wire cable and an isolated magnetic wire, the closed IDC terminal comprising:

a contact interface terminal formed by a single material having a constant thickness, contact interface terminal further having one or more flaps for insertion into a casing; and the casing to receive the contact interface terminal, the multi-wire cable, and the magnetic wire, the casing further having one or more windows to receive the flaps;

wherein the terminal has a hole for inserting the multi-wire cable, a closed channel linked to the hole, the closed channel having a smaller diameter than the hole, an opening to receive the magnetic wire, and a slot linked to the opening, the slot having a smaller diameter than the opening.

* * * * *